US006288013B1

(12) United States Patent
Sivik et al.

(10) Patent No.: US 6,288,013 B1
(45) **Date of Patent: *Sep. 11, 2001**

(54) NITROGEN CONTAINING DISPERSANT-VISCOSITY IMPROVERS

(75) Inventors: Matthew R. Sivik, Parma; Richard M. Lange, Euclid; Paul E. Adams, Willoughby Hills; Daniel M. Vargo, Willoughby, all of OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/984,301

(22) Filed: Dec. 3, 1997

(51) Int. Cl.[7] ..... C10M 133/44

(52) U.S. Cl. ..... 508/279; 508/231; 508/186; 525/55; 525/92 F; 525/281

(58) Field of Search ..... 508/231, 279, 508/186

(56) References Cited

U.S. PATENT DOCUMENTS

| | | | | |
|---|---|---|---|---|
| 4,089,794 | | 5/1978 | Engel et al. | 252/51.5 A |
| 4,102,798 | | 7/1978 | Ryer et al. | 252/51.5 A |
| 4,113,639 | | 9/1978 | Lonstrup et al. | 252/51.5 A |
| 4,171,273 | | 10/1979 | Waldbillig et al. | 252/51.5 A |
| 4,491,527 | | 1/1985 | Lange et al. | 252/51.5 A |
| 4,500,440 | * | 2/1985 | Kaufman et al. | 525/331.7 |
| 4,517,104 | | 5/1985 | Bloch et al. | 252/51.5 A |

(List continued on next page.)

FOREIGN PATENT DOCUMENTS

| | | |
|---|---|---|
| 0099478 | 2/1984 | (EP) . |
| 0325307 | 7/1989 | (EP) . |
| 0449374 | 10/1991 | (EP) . |
| 0759435A2 | 2/1997 | (EP) . |
| 0759443A2 | 2/1997 | (EP) . |
| 0759444A2 | 2/1997 | (EP) . |
| 0802255 | 10/1997 | (EP) . |
| 0802256 | 10/1997 | (EP) . |
| 98/05741 | 2/1998 | (WO) . |

*Primary Examiner*—Jacqueline V. Howard
(74) *Attorney, Agent, or Firm*—Joseph P. Fischer; David M. Shold

(57) ABSTRACT

A composition comprising a hydrocarbon polymer having $\bar{M}_n$ ranging from 20,000 to about 500,000, when the polymer is not a star polymer, and up to about GPC peak molecular weight of 4,000,000 when the polymer is a star polymer having attached thereto pendant groups $A_a$ and $B_b$ wherein each A is independently selected from members of the group consisting of:

groups of the formula (I)

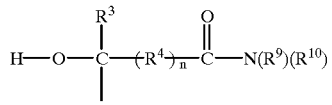

wherein $R^3$ is H or hydrocarbyl, $R^4$ is a divalent hydrocarbylene group, n=0 or 1, and each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_cR^{11}-M$, wherein each Y is independently a group of the formula

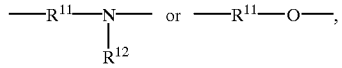

each $R^{11}$ is a divalent hydrocarbyl group, $R^{12}$ is as defined above for $R^9$ and $R^{10}$, and M is H, hydrocarbyl, amino, an amide group, an amide-containing group, an acylamino group, an imide group, or an imide-containing group, and c is 0 or a number ranging from 1 to about 100, or one of $R^9$ and $R^{10}$ taken together with the adjacent N constitute a N—N group; and each B is independently selected from members of the group of formula:

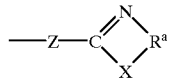

wherein each X is independently O, S, or $NR^b$, each $R^b$ is independently H, $NH_2$, hydrocarbyl, hydroxy-hydrocarbyl or aminohydrocarbyl, and each Z is independently a group of the formula

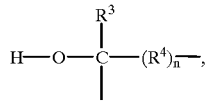

wherein each of $R^3$, $R^4$, and n is as defined hereinabove; $R^a$ is an ethylene group, a propylene group, which groups optionally have hydrocarbyl or hydroxyhydrocarbyl substituents, or

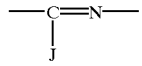

wherein J is H, SH, $NH_2$, or OH, and tautomers thereof; a is 0 or a number ranging from 1 to about 50, and b is a number ranging from 1 to about 30.

16 Claims, No Drawings

U.S. PATENT DOCUMENTS

| | | | | |
|---|---|---|---|---|
| 4,632,769 | | 12/1986 | Gutierrez et al. | 252/48.6 |
| 4,670,173 | | 6/1987 | Hayashi et al. | 252/51.5 A |
| 4,735,736 | | 4/1988 | Chung | 252/48.6 |
| 4,863,623 | * | 9/1989 | Nalesnik | 525/232 |
| 4,957,645 | | 9/1990 | Emert et al. | 252/47.5 |
| 5,035,821 | | 7/1991 | Chung et al. | 252/51.5 A |
| 5,049,294 | | 9/1991 | Van Zon et al. | 252/51.5 A |
| 5,053,152 | | 10/1991 | Steckel | 252/51.5 R |
| 5,080,815 | | 1/1992 | Fenoglio et al. | 252/51.5 A |
| 5,174,915 | | 12/1992 | Hutchinson et al. | 252/50 |
| 5,232,614 | | 8/1993 | Colclough et al. | 252/32.7 |
| 5,454,962 | | 10/1995 | Slama et al. | 252/51.5 A |
| 5,496,480 | | 3/1996 | Rollin et al. | 252/51.5 A |
| 5,512,192 | | 4/1996 | Lange et al. | 252/51.5 A |
| 5,540,851 | | 7/1996 | Lange | 508/194 |
| 5,646,098 | | 7/1997 | Brois | 508/189 |
| 5,696,060 | | 12/1997 | Baker et al. | 508/222 |
| 5,696,067 | | 12/1997 | Adams et al. | 508/476 |

* cited by examiner

NITROGEN CONTAINING DISPERSANT-VISCOSITY IMPROVERS

FIELD OF THE INVENTION

This invention relates to dispersant-viscosity improvers for lubricating oils and fuels, processes for preparing them, additive concentrates, and lubricating oil and fuel compositions.

BACKGROUND OF THE INVENTION

The viscosity of hydrocarbonaceous liquids, for example fuels and lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193; C. V. Smalheer and R. K. Smith, "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

Dispersant-viscosity improvers are generally prepared by functionalizing, i.e., adding polar groups, to a hydrocarbon polymer.

Hayashi et al, U.S. Pat. No. 4,670,173 relates to compositions suitable for use as dispersant-viscosity improvers made by reacting an acylating reaction product which is formed by reacting a hydrogenated block copolymer and an alpha,beta olefinically unsaturated reagent in the presence of free-radical initiators, then reacting the acylating product with a primary amine and optionally with a polyamine and a mono-functional acid.

Lange, et al, U.S. Pat. No. 4,491,527 relates to ester-heterocycle compositions useful as "lead paint" inhibitors in lubricants. The compositions comprise derivatives of substituted carboxylic acids in which the substituent is a substantially aliphatic, substantially saturated hydrocarbon based radical containing at least about 30 aliphatic carbon atoms; said derivatives being the combination of: (A) at least one ester of said carboxylic acids in which all the alcohol moieties are derived from at least on mono- or polyhydroxyalkane; and (B) at least one heterocyclic condensation product of said substituted carboxylic acids containing at least one heterocyclic moiety which includes a 5- or 6-membered ring which contains at least two ring hetero atoms selected from the group consisting of oxygen, sulfur and nitrogen separated by a single carbon atom, at least one of said hetero atoms being nitrogen, and at least one carboxylic moiety; the carboxylic and heterocyclic moieties either being linked through an ester or amide linkage or being the same moiety in which said single carbon atom separating two ring hetero atoms corresponds to a carbonyl carbon atom of the substituted carboxylic acid.

Lange, et al, U.S. Pat. No. 5,512,192 teach dispersant viscosity improvers for lubricating oil compositions comprising a vinyl substituted aromatic-aliphatic conjugated diene block copolymer grafted with an ethylenically unsaturated carboxylic acid reacted with at least one polyester containing at least one condensable hydroxy group and at least one polyamine having at least one condensable primary or secondary amino group, and optionally, at least one hydrocarbyl substituted carboxylic acid or anhydride.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an alpha,beta-unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the preformed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Lange, U.S. Pat. No. 5,540,851 describes dispersant viscosity improvers for lubricating oil compositions which are the reaction product of (a) an oil soluble ethylene-alpha olefin copolymer wherein the alpha olefin is selected from the group consisting of $C_{3-28}$ alpha olefins, said polymer having a number average molecular weight ranging from about 30,000 to about 300,000 grafted with an ethylenically unsaturated carboxylic acid or functional derivative thereof; with at least one polyester containing at least one condensable hydroxyl group, and at least one polyamine having at least one condensable primary or secondary amino group, and optionally at least one hydrocarbyl substituted carboxylic acid or anhydride.

Each of these patents is hereby expressly incorporated herein by reference.

For additional disclosures concerning multi-purpose additives and particularly viscosity improvers and dispersants, the disclosures of the following United States patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,864,098 |
| 3,312,619 | 3,598,738 | 3,864,268 |
| 3,326,804 | 3,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

Many such additives are frequently derived from carboxylic reactants, for example, acids, esters, anhydrides, lactones, and others. Specific examples of commonly used carboxylic compounds used as intermediates for preparing lubricating oil additives include alkyl-and alkenyl substituted succinic acids and anhydrides, polyolefin substituted carboxylic acids, aromatic acids, such as salicylic acids, and others. Illustrative carboxylic compounds are described in Meinhardt, et al, U.S. Pat. No. 4,234,435; Norman et al, U.S. Pat. No. 3,172,892; LeSuer et al, U.S. Pat. No. 3,454,607, and Rense, U.S. Pat. No. 3,215,707.

All of the foregoing patents and publications and all of those mentioned hereinafter are hereby incorporated herein by reference.

Many carboxylic intermediates used in the preparation of lubricating oil additives contain chlorine. While the amount of chlorine present is often only a very small amount of the total weight of the intermediate, the chlorine frequently is carried over into the carboxylic derivative which is desired as an additive. For a variety of reasons, including environmental reasons, the industry has been making efforts to reduce or to eliminate chlorine from compositions designed for use as lubricant or fuel additives.

Accordingly, it is desirable to provide low chlorine or chlorine free derivatives for use as additives in lubricants.

A further object is to provide processes for preparing such additives.

Other objects will in part be obvious in view of this disclosure and will in part appear hereinafter.

SUMMARY OF THE INVENTION

This invention relates to a composition comprising a hydrocarbon polymer having $\overline{M}_n$ ranging from 20,000 to about 500,000, when the polymer is not a star polymer, and up to about GPC peak molecular weight of 4,000,000 when the polymer is a star polymer having attached thereto pendant groups $A_a$ and $B_b$ wherein each A is independently selected from members of the group consisting of: groups of the formula (I)

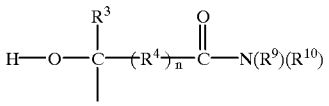

wherein $R^3$ is H or hydrocarbyl, $R^4$ is a divalent hydrocarbylene group, n=0 or 1, and each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_c-R^{11}-M$, wherein each Y is independently a group of the formula

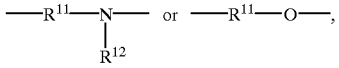

each $R^{11}$ is a divalent hydrocarbyl group, $R^{12}$ is as defined above for $R^9$ and $R^{10}$, and M is H, hydrocarbyl, amino, —OH, an amide group, an amide-containing group, an acylamino group, an imide group, a heterocyclic group, an imide-containing group, or, —SR', wherein R' is H or hydrocarbyl, and c is 0 or a number ranging from 1 to about 100, or one of $R^9$ and $R^{10}$ taken together with the adjacent N constitute a N—N group; and each B is independently selected from members of the group of formula:

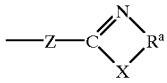

wherein each X is independently O, S, or NR, each $R^b$ is independently H, $NH_2$, hydrocarbyl, hydroxy-hydrocarbyl or aminohydrocarbyl, and each Z is independently a group of the formula

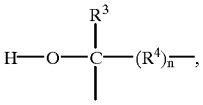

wherein each of $R^3$, $R^4$, and n is as defined hereinabove; each $R^a$ is independently an ethylene group, a propylene group, which groups optionally have hydrocarbyl or hydroxyhydrocarbyl substituents, or

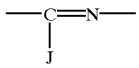

wherein J is H, SH, $NH_2$, or OH, and tautomers thereof, the subscript a is 0 or a number ranging from 1 to about 50, and the subscript b is a number ranging from 1 to about 30. Preferably, no more than three of $R^9$, $R^{10}$ and $R^{12}$ contain amide groups,, imide-containing groups, acylamino groups or amide-containing groups.

DETAILED DESCRIPTION OF THE PREFERRED EMBODIMENTS

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms provided that they do not adversely affect reactivity or utility of the process or products of this invention.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated into a lubricating oil. For a further discussion of the terms oil soluble and dispersible, particularly "stably dispersible", see U.S. Pat. No. 4,320,019 which is expressly incorporated herein by reference for relevant teachings in this regard.

The expression "lower" is used throughout the specification and claims. As used herein to describe various groups, the expression "lower" is intended, unless expressly indicated otherwise, to mean groups containing no more than 7 carbon atoms, more often, no more than 4, frequently one or two carbon atoms.

The Hydrocarbon Polymer with Groups A and B

The hydrocarbon polymer onto which are attached the groups A and B is derived from (P) an olefinically unsaturated hydrocarbon polymer as described in greater detail hereinafter, and optionally, mixtures of the polymer (P) and olefinically unsaturated compounds having molecular weight ranging from about 100 to less thanm 20,000.

When mixtures are used, they typically comprise from about 1% by weight, often from about 5%, occasionally from about 10% up to about 50% by weight, often up to about 25% by weight of olefinically unsaturated compound having molecular weight ranging from about 100 to less than 20,000.

The polymer onto which groups A and B are attached may contain up to about 5% residual olefinic unsaturation, that is, up to about 5% of the carbon to carbon bonds may be olefinically unsaturated. Preferably, no more than about 1%, even more often no more than about 0.1% of the carbon to carbon bonds are unsaturated. Most preferably the polymer is substantially saturated, that is, all of the carbon to carbon bonds are saturated or only a minor, insignificant number of carbon to carbon bonds are olefinically unsaturated.

The extent of olefinic unsaturation which may remain in the hydrocarbon polymer after attachment of groups A and B may be adjusted by hydrogenation of some of the olefinic bonds present in (P) before reaction with a carboxylic reactant (G) as discussed in greater detail hereinafter. Alternatively, the intermediate arising from reaction of (P) and (G) may be hydrogenated, if desired to reduce or eliminate remaining unsaturation.

The groups A and B are attached to the hydrocarbon polymer as set forth in greater detail hereinbelow.

The Group A

The hydrocarbon polymer may have attached thereto one or more groups A which consist of groups of the formula (I)

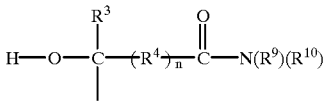

wherein $R^3$ is H or hydrocarbyl, $R^4$ is a divalent hydrocarbylene group, n=0 or 1, and each of $R^9$ and $R^{10}$ is independently H, alkoxyhydrcocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_c-R^{11}-M$, wherein each Y is independently a group of the formula

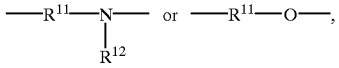

each $R^{11}$ is a divalent hydrocarbyl group, $R^{12}$ is as defined above for $R^9$ and $R^{10}$, and M is H, hydrocarbyl, amino, —OH, an amide group, an amide-containing group, an acylamino group, an imide group, a heterocyclic group, for example a morpholine group, a piperidine group, a piperazine group, a thiadiazole group, and other heterocyclic groups containing at least one ring S, N or O atom, an imide-containing group, or —SR' wherein R' is H or hydrocarbyl, preferably H or lower alkyl, and c is 0 or a number ranging from 1 to about 100, or one of $R^9$ and $R^{10}$ taken together with the adjacent N constitute a N—N group. Preferably, no more than three $R^9$, $R^{10}$, and $R^{12}$ contain amide groups, imide-containing groups, acylamino groups or amide-containing groups.

$R^3$ is H or hydrocarbyl. These hydrocarbyl groups are usually aliphatic, that is, alkyl or alkenyl, preferably alkyl, more preferably lower alkyl. Especially preferred is where $R^3$ is H or methyl, most preferably, H.

$R^4$ is a divalent hydrocarbylene group. This group may be aliphatic or aromatic, but is usually aliphatic. Often, $R^4$ is an alkylene group containing from 1 to about 3 carbon atoms. The 'n' is 0 or 1; that is, in one embodiment $R^4$ is present and in another embodiment, $R^4$ is absent. More often, $R^4$ is absent.

In one preferred embodiment, $R^3$ is hydrogen or a lower alkyl or alkenyl group. In one especially preferred embodiment, $R^3$ is hydrogen and n=0.

The subscript a denotes the number of A groups. The subscript a is 0 or ranges from 1 to about 50. When a=0, the group A is absent. Often, a ranges from 1 to about 10.

The Group B

The hydrocarbon polymer has attached thereto one or more groups B, each of which is independently selected from members of the group of formula:

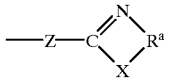

wherein each X is independently O, S, or $NR^b$, each $R^b$ is independently H, $NH_2$, hydrocarbyl, hydroxy-hydrocarbyl or aminohydrocarbyl, and each Z is independently a group of the formula

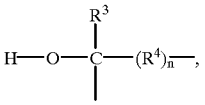

wherein each of $R^3$, $R^4$, and n is as defined hereinabove;

$R^a$ is an ethylene group, a propylene group, which groups optionally have hydrocarbyl or hydroxyhydrocarbyl substituents, or

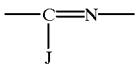

wherein J is H, SH, $NH_2$, or OH, and tautomers thereof; the subscript b is a number ranging from 1 to about 30.

The compositions of this invention may be prepared by a process which comprises first reacting, optionally in the presence of an acid catalyst, (P) an olefinically unsaturated hydrocarbon polymer having $\overline{M}_n$ ranging from 20,000 to about 500,000 when the polymer is not a star polymer, and up to about GPC peak molecular weight of 4,000,000 when the polymer is a star polymer, with (G) from about 0.1 to about 3 moles per mole-equivalent of (P), often from about 0.8 moles to about 1.2 moles, more often from about 0.95 moles to about 1.05 moles per mole-equivalent of (P). of at least one carboxylic reactant selected from the group consisting of compounds of the formula $$R^3C(O)(R^4)_nC(O)OR^5 \quad \text{(IV)}$$

wherein each of $R^3$ and $R^5$ is independently H or a hydrocarbyl group, $R^4$ is a divalent hydrocarbylene group, and n is 0 or 1, and reactive sources thereof to form a carboxylic group containing intermediate, then reacting said intermediate with (C) from about 0.5 to about 1.25 equivalents, per equivalent of carboxylic acid or reactive source thereof, of a heterocycle precursor.

The amount of (G) reacted per mole of (P) will depend, in part, on the amount of olefinic unsaturation present in (P). For use as an intermediate for further reaction with (C) to prepare dispersant-viscosity improver additives for lubricating oils, the amount of (G) reacted with (P) often will range from about 1 to about 100 moles (G) per mole of (P) wherein one mole of (P) is defined herein as the number average molecular weight of (P). Preferably, in this embodiment from about 2, often from about 5, up to about 50 moles (G), often up to about 20, frequently up to about 10 moles (G) are utilized per mole of (P).

The process of this invention comprising reacting (P) and (G) is conducted at temperatures ranging from ambient, usually from about 60° C., often from about 100° C., up to about 250° C., more often up to about 180° C., preferably up to about 160° C.

The reaction with the heterocycle precursor is conducted at temperatures ranging from about 100° C. to about 250° C., preferably from about 120° C. to about 180° C., and occasionally from about 180° C. to about 225° C. for a sufficient time to convert at least about 50% of the carboxylic groups to heterocyclic groups.

One or both steps of the process may be conducted in the presence of a diluent, usually an oil of lubricating viscosity. Other diluents may be used; particularly if it is desired to remove the diluent before further use of the product. Such other diluents include relatively low boiling point liquids such as hydrocarbon solvents and the like.

The process may be conducted in a kettle type reactor. Under these conditions, it is frequently advantageous to utilize a diluent to improve processing. Alternatively, other reactors may be used. In one particular embodiment, the reactor is an extruder. Usually, processing in an extruder does not require the use of a diluent, although a diluent may be used if desired. It is not necessary that both steps of the process be conducted in the same type of reactor.

(P)) The Olefinically Unsaturated Hydrocarbon Polymer

As used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The olefinically unsaturated hydrocarbon polymer is an essentially hydrocarbon based polymer, usually one having a number average molecular weight ($\overline{M}_n$) between 20,000 and about 500,000, often from 20,000 to about 300,000. Molecular weights of the hydrocarbon polymer are determined using well known methods described in the literature. Examples of procedures for determining the molecular weights are gel permeation chromatography (GPC) (also known as size-exclusion chromatography) and vapor phase osmometry (VPO). These and other procedures are described in numerous publications including:

P. J. Flory, "Principles of Polymer Chemistry", Cornell University Press (1953), Chapter VII, pp 266–316, "Macromolecules, an Introduction to Polymer Science", F. A. Bovey and F. H. Winslow, Editors, Academic Press (1979), pp 296–312, and W. W. Yau, J. J. Kirkland and D. D. Bly, "Modern Size Exclusion Liquid Chromatography", John Wiley and Sons, New York, 1979.

Unless otherwise indicated, GPC molecular weights referred to herein are polystyrene equivalent weights, i.e., are molecular weights determined employing polystyrene standards.

A measurement which is complementary to a polymer's molecular weight is the melt index (ASTM D-1238). Polymers of high melt index generally have low molecular weight, and vice versa. The polymers of the present invention preferably have a melt index of up to 20 dg/min., more preferably 0.1 to 10 dg/min.

These publications are hereby incorporated by reference for relevant disclosures contained therein relating to the determination of molecular weight.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673 which is hereby incorporated herein by reference for relevant disclosures in this regard. Reducing molecular weight also tends to improve the subsequent shear stability of the polymer.

The polymer may contain aliphatic, aromatic or cycloaliphatic components, or mixtures thereof. When the polymer is prepared from the monomers, it may contain substantial amounts of olefinic unsaturation, oftentimes far in excess of that which is desired for this invention. The polymer may be subjected to hydrogenation to reduce the amount of unsaturation to such an extent that the resulting hydrogenated polymer has olefinic unsaturation, based on the total number of carbon to carbon bonds in the polymer, of less than 5%, frequently less than 2%, often no more than 1% olefinic unsaturation. As noted hereinabove, the hydrocarbon polymer is olefinically unsaturated. Accordingly, the polymer contains one or more olefinic double bonds. When the polymer is subjected to hydrogenation, it is not exhaustively hydrogenated.

Typically, from about 90 to about 99.9% of carbon to carbon bonds in the polymer are saturated.

Aromatic unsaturation is not considered olefinic unsaturation within the context of this invention. Depending on hydrogenation conditions, up to about 20% of aromatic groups may be hydrogenated; however, typically no more than about 5%, usually less than 1% of aromatic bonds are hydrogenated. Most often, substantially none of the aromatic bonds are hydrogenated.

Typically, (P) the olefinically unsaturated polymer contains an average of from 1 to about 9000 olefinic double bonds, more often from about 1 to about 100 olefinic double bonds, even more often from about 1, frequently 2 to about 10, up to about 50 olefinic double bonds per molecule based on the $\overline{M}_n$ of the polymer. In another embodiment, (P) contains about 1 olefinic double bond for about every 20, often for about every 70 to 7000 carbon atoms. In still another embodiment, the hydrocarbon polymer (P) contains about 1 olefinic double bond for every 4,000 to 20,000 on $\overline{M}_n$ basis, often, about 1 olefinic double bond per 1,000 to 40,000 on $\overline{M}_n$ basis. Thus, for example, in this embodiment a polymer of $\overline{M}_n$=80,000 would contain from about 2 to about 80 olefinic double bonds per molecule, often from about 4 to about 20 double bonds per molecule. In yet another embodiment, the hydrocarbon polymer (P) contains about 1 olefinic double bond for about every 300 to 100,000 on $\overline{M}_n$ basis.

The equivalent weight per mole of carbon to carbon double bonds is defined herein as the mole-equivalent weight. For example, a polymer having $\overline{M}_n$ of 100,000 and which contains an average of 4 moles of carbon to carbon double bonds, has a mole equivalent weight of 100,000/4= 25,000. Conversely, the polymer has one mole of carbon to carbon double bonds per 25,000 $\overline{M}_n$.

In preferred embodiments, the hydrocarbon polymer is at least one oil soluble or dispersible homopolymer or copolymer selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

These preferred polymers are described in greater detail hereinbelow.

(1) Polymers of Dienes

The hydrocarbon polymer may be a homopolymer or copolymer of one or more dienes. The dienes may be conjugated such as isoprene, butadiene and piperylene or non-conjugated such as 1–4 hexadiene, ethylidene norbomene, vinyl norbomene, 4-vinyl cyclohexene, and dicyclopentadiene. Polymers of conjugated dienes are preferred. Such polymers are conveniently prepared via free radical and anionic polymerization techniques. Emulsion techniques are commonly employed for free radical polymerization.

As noted hereinabove, useful polymers have $\overline{M}_n$ ranging from 20,000 to about 500,000. More often, useful polymers of this type have $\overline{M}_n$ ranging from about 50,000 to about 150,000.

These polymers may be and often are hydrogenated to reduce the amount of olefinic unsaturation present in the polymer. They are not exhaustively hydrogenated.

Hydrogenation is often accomplished employing catalytic methods. Catalytic techniques employing hydrogen under high pressure and at elevated temperature are well-known to those skilled in the chemical art. Other methods are also useful and are well known to those skilled in the art.

Extensive discussions of diene polymers appear in the "Encyclopedia of Polymer Science and Engineering", Volume 2, pp 550–586 and Volume 8, pp 499–532, Wiley-Interscience (1986), which are hereby expressly incorporated herein by reference for relevant disclosures in this regard.

The polymers include homopolymers and copolymers of conjugated dienes including polymers of 1,3-dienes of the formula

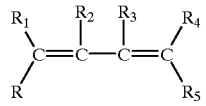

wherein each substituent denoted by R, or R with a numerical subscript, is independently hydrogen or hydrocarbon based, wherein hydrocarbon based is as defined hereinabove. Preferably at least one substituent is H. Normally, the total carbon content of the diene will not exceed 20 carbons. Preferred dienes for preparation of the polymer are piperylene, isoprene, 2,3-dimethyl-1,3-butadiene, chloroprene and 1,3-butadiene.

Suitable homopolymers of conjugated dienes are described, and methods for their preparation are given in numerous U.S. patents, including the following:

U.S. Pat. No. 3,547,821

U.S. Pat. No. 3,835,053

U.S. Pat. No. 3,959,161

U.S. Pat. No. 3,965,019

U.S. Pat. No. 4,085,055

U.S. Pat. No. 4,116,917

As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. The following U.S. Patents describe diene copolymers and methods for preparing them:

U.S. Pat. No. 3,965,019

U.S. Pat. No. 4,073,737

U.S. Pat. No. 4,085,055

U.S. Pat. No. 4,116,917

For example, U.S. Pat. No. 4,073,737 describes the preparation and hydrogenation of butadiene-isoprene copolymers.

(2) Copolymers of Conjugated Dienes with Vinyl Substituted Aromatic Compounds

In one embodiment, the hydrocarbon polymer is a copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms.

These polymers may be, and often are, hydrogenated to reduce the amount of olefinic unsaturation present in the polymer. They are not exhaustively hydrogenated.

Examples of vinyl substituted aromatics include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene, and chlorostyrene with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and 1,3-butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60%, by weight.

The polymers, and in particular, styrene-diene copolymers, can be random copolymers or block copolymers, which include regular block copolymers or random block copolymers. Random copolymers are those in which the comonomer; are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. Thus, a linear regular diblock copolymer of styrene or other vinyl aromatic monomer (S) and diene (D) would have a general structure represented by a large block of homopolymer (S) attached to a large block of homopolymer (D), as:

$$(S)_s(D)_d$$

where subscripts s and d are as described hereinbelow. Similarly, a regular linear tri-block copolymer of styrene or other vinyl aromatic monomer (S) and diene monomer (D) may be represented, for example, by (S)hd $s(D)_d(S)_s$ or $(D)_d(S)_s(D)_d$. Techniques vary for the preparation of these "S-D-S" and "D-S-D" triblock polymers, and are described in the literature for anionic polymerization.

A third monomer (T) may be incorporated into linear, regular block copolymers. Several configurations are possible depending on how the homopolymer segments are arranged with respect to each other. For example, linear triblock copolymers of monomers (S), (D) and (T) can be represented by the general configurations:

$$(S)_s\text{-}(D)_d\text{-}(T)_t,\ (S)_s\text{-}(T)_t\text{-}(D)_d,\ \text{or}\ (D)_d\text{-}(S)_s\text{-}(T)_t,$$

wherein the lower case letters s, d and t represent the approximate number of monomer units in the indicated block.

The sizes of the blocks are not necessarily the same, but may vary considerably. The only stipulation is that any regular block copolymer comprises relatively few, but relatively large, alternating homopolymer segments.

As an example, when (D) represents blocks derived from diene such as isoprene or butadiene, "d" usually ranges from about 100 to about 2000, preferably from about 500 to about 1500; when (S) represents, for example, blocks derived from styrene, "s" usually ranges from about 100 to about 2000, preferably from about 200 to about 1000; and when a third block (T) is present, "t" usually ranges from about 10 to about 1000, provided that the $\overline{M}_n$ of the polymer is within the ranges indicated as useful for this invention.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styrene/diene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group Ia metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0). At this point, addition of 1,3-butadiene, isoprene or other suitable anionically polymerizable monomer to the homopolystyrene-lithium "living" polymer produces a second segment which grows from the terminal anion site to produce a living di-block polymer having an anionic terminus, with lithium gegenion.

Subsequent introduction of additional styrene can produce a new poly S-block-poly D-block-poly S, or S-D-S triblock polymer; higher orders of block polymers can be made by consecutive stepwise additions of different monomers in different sequences.

Alternatively, a living diblock polymer can be coupled by exposure to an agent such as a dialkyl dichlorosilane. When the carbanionic "heads" of two S-D diblock living polymers are coupled using such an agent, precipitation of LiCl occurs to give an S-D-S triblock polymer.

Block copolymers made by consecutive addition of styrene to give a relatively large homopolymer segment (S), followed by a diene to give a relatively large homopolymer segment (D), are referred to as poly-S-block-poly-D copolymers, or S-D diblock polymers.

When metal naphthalide is employed as initiator, the dianion formed by electron transfer from metal, e.g., Na, atoms to the naphthalene ring can generate dianions which may initiate polymerization, e.g. of monomer S, in two directions simultaneously, producing essentially a homopolymer of S having anionic termini at both ends.

Subsequent exposure of the poly (S) dianion to a second monomer (D) results in formation of a poly D-block-poly S-block-poly D, or a D-S-D triblock polymeric dianion, which may continue to interact with additional anionically-polymerizable monomers of the same, or different chemical type, in the formation of higher order block polymers. Ordinary block copolymers are generally considered, to have up to about 5 such blocks.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer". When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, resulting in a "tapered block copolymer."

An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis-addition.

These polymers may have considerable olefinic unsaturation, which may be reduced, if desired. Hydrogenation to reduce the extent of olefinic unsaturation may be carried out to reduce approximately 90–99.1% of the olefinic unsaturation of the initial polymer, such that from about 90 to about 99.9% of the carbon to carbon bonds of the polymer are saturated. In general, it is preferred that these copolymers contain no more than about 10%, preferably no more than 5% and often no more than about 0.5% residual olefinic unsaturation on the basis of the total amount of olefinic double bonds present in the polymer prior to hydrogenation. As noted above, the polymers are olefinically unsaturated; accordingly, the polymers are not exhaustively hydrogenated. Unsaturation can be measured by a number of means well known to those of skill in the art, including infrared, nuclear magnetic resonance spectroscopy, bromine number, iodine number, and other means. Aromatic unsaturation is not considered to be olefinic unsaturation within the context of this invention.

Hydrogenation techniques are well known to those of skill in the art. One common method is to contact the copolymers with hydrogen, often at superatmospheric pressure in the presence of a metal catalyst such as colloidal nickel, palladium supported on charcoal, etc. Hydrogenation may be carried out as part of the overall production process, using finely divided, or supported, nickel catalyst. Other transition metals may also be used to effect the transformation. Other techniques are known in the art.

Other polymerization techniques such as emulsion polymerization can be used.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, (1986);
2) A. Noshay and J. E. McGrath, "Block Copolymers", Academic Press, New York, (1977);
3) R. J. Ceresa, ed., "Block and Graft Copolymerization", John Wiley and Sons, New York, (1976); and
4) D. J. Meier, ed., (Block Copolymers", MMI Press, Harwood Academic Publishers, New York, (1979).

Each of these is hereby incorporated herein by reference for relevant disclosures relating to block copolymers.

Examples of suitable commercially available regular linear diblock copolymers as set forth above include Shellvis-40, and Shellvis-50, both hydrogenated styrene-isoprene block copolymers, manufactured by Shell Chemical.

Examples of commercially available random block and tapered block copolymers include the various Glissoviscal styrene-butadiene copolymers manufactured by BASF. A previously available random block copolymer was Phil-Ad viscosity improver, manufactured by Phillips Petroleum.

The copolymers preferably have $\overline{M}_n$ in the range of 20,000 to about 500,000, more preferably from about 30,000 to about 150,000. The weight average molecular weight ($\overline{M}_w$) for these copolymers is generally in the range of about 50,000 to about 500,000, preferably from about 50,000 to about 300,000.

Copolymers of conjugated dienes with olefins containing aromatic groups, e.g., styrene, methyl styrene, etc. are described in numerous patents including the following:

| | |
|---|---|
| 3,554,911 | 4,082,680 |
| 3,992,310 | 4,085,055 |
| 3,994,815 | 4,116,917 |
| 4,031,020 | 4,136,048 |
| 4,073,738 | 4,145,298 |
| 4,077,893 | |

For example, U.S. Pat. No. 3,554,911 describes a random butadiene-styrene copolymer, its preparation and hydrogenation.

(3) Polymers of Aliphatic Olefins

Another useful hydrocarbon polymer is one which in its main chain is composed essentially of aliphatic olefin, especially alpha olefin, monomers. The polyolefins of this embodiment thus exclude polymers which have a large component of other types of monomers copolymerized in the main polymer, such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible polymers of alpha-olefins.

The olefin copolymer preferably has a number average molecular weight ($\overline{M}_n$) determined by gel-permeation chromatography employing polystyrene standards, ranging from 20,000 to about 500,000, often from about 30,000 to about 300,000, often to about 200,000, more often from about 50,000 to about 150,000, even more often from about 80,000 to about 150,000. Exemplary polydispersity values ($\overline{M}_w/\overline{M}_n$) range from about 1.5 to about 3.5, often to about 3.0, preferably, from about 1.7, often from about 2.0, to about 2.5.

These polymers are preferably polymers of alpha-olefins having from 2 to about 28 carbon atoms. Preferably they are copolymers, more preferably copolymers of ethylene and at least one other α-olefin having from 3 to about 28 carbon atoms, i.e., one of the formula $CH_2{=}CHR_1$ wherein $R_1$ is straight chain or branched chain alkyl radical comprising 1 to 26 carbon atoms. Examples include monoolefins such as propylene, 1-butene, isobutene, 1-pentene, 1-hexene, 1-heptene, 1-octene, 1-nonene, 1-decene, etc. Preferably $R_1$ in the above formula is alkyl of from 1 to 8 carbon atoms, and more preferably is alkyl of from 1 to 2 carbon atoms. Preferably, the polymer of olefins is an ethylene-propylene copolymer.

The ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present. Most preferably, these polymers are substantially free of ethylene homopolymer, although they may exhibit a degree of crystallinity due to the presence of small crystalline polyethylene segments within their microstructure.

In one particular embodiment, the polymer is a homopolymer derived from a butene, particularly, isobutylene. Especially preferred is where the polymer comprises, terminal vinylidene olefinic double bonds.

The polymers employed in this embodiment may generally be prepared substantially in accordance with procedures which are well known in the art.

Catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Other useful polymerization catalysts are the metallocene compounds. These are organometallic coordination compounds obtained as cyclopentadienyl derivatives of a transition metal or metal halide. The metal is bonded to the cyclopentadienyl ring by electrons moving in orbitals extending above and below the plane of the ring (π bond). The use of such materials as catalysts for the preparation of ethylene-alpha olefin copolymers is described in U.S. Pat. No. 5,446,221. The procedure described therein provides ethylene-alpha olefin copolymers having at least 30% of terminal ethenylidene unsaturation. This patent is hereby incorporated herein by reference for relevant disclosures.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

In those situations wherein the molecular weight of the polymer product that would be produced at a given set of operating conditions is higher than desired, any of the techniques known in the prior art for control of molecular weight, such as polymerization temperature control, may be used.

The polymers are preferably formed in the substantial absence of added $H_2$ gas, that is $H_2$ gas added in amounts effective to substantially reduce the polymer molecular weight.

The polymers can be random copolymers, block copolymers, and random block copolymers. Ethylene propylene copolymers are usually random copolymers. Block copolymers may be obtained by conducting the reaction in a tubular reactor. Such a procedure is described in U.S. Pat. No. 4,804,794 which is hereby incorporated by reference for relevant disclosures in this regard. Numerous United States patents, including the following, describe the preparation of copolymers of alpha olefins.

| | |
|---|---|
| 3,513,096 | 4,068,057 |
| 3,551,336 | 4,081,391 |
| 3,562,160 | 4,089,794 |
| 3,607,749 | 4,098,710 |
| 3,634,249 | 4,113,636 |
| 3,637,503 | 4,132,661 |
| 3,992,310 | 4,137,185 |
| 4,031,020 | 4,138,370 |
| 4,068,056 | 4,144,181 |

Copolymers of ethylene with higher alpha olefins are the most common copolymers of aliphatic olefins. Ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference.

Useful ethylene-alpha olefin, usually ethylene-propylene, copolymers are commercially available from numerous sources including the Exxon, Texaco and Lubrizol Corporations.

(4) Olefin-Diene Copolymers

Another useful hydrocarbon polymer is one derived from olefins, especially lower olefins, and dienes. Preferred olefins are alpha olefins. Dienes may be non-conjugated or conjugated, usually non-conjugated. Useful olefins and dienes are the same as those described hereinabove and hereinafter in discussions of other polymer types.

In one embodiment, the copolymer is an ethylene-lower olefin-diene copolymer. As used herein, the term lower refers to groups or compounds containing no more than 7 carbon atoms. Preferably, the diene is non-conjugated. Especially preferred are ethylene-propylene-diene copolymers.

These copolymers most often will have $\overline{M}_n$ ranging from 20,000 to about 500,000, preferably from about 50,000 to about 200,000. In another embodiment:, the $\overline{M}_n$ ranges from about 70,000 to about 350,000. These polymers often have a relatively narrow range of molecular weight as represented by the polydispersity value $\overline{M}_w/\overline{M}_n$. Typically, the polydispersity values are less than 10, more often less than 6, and preferably less than 4, often between 2 and 3.

There are numerous commercial sources for lower olefin-diene copolymers. For example, Ortholeum® 2052 (a product marketed by the DuPont Company) which is a terpolymer having an ethylene:propylene weight ratio of about 57:43 and containing 4–5 weight % of groups derived from 1,4-hexadiene monomer. Other commercially available olefin-diene copolymers including ethylene-propylene copolymers with ethylidene norbornene, with dicyclopentadiene, with vinyl norbomene, with 4-vinyl cyclohexene, and numerous other such materials are readily available. Olefin-diene copolymers and methods for their preparation are described in numerous patents including the following U.S. Patents:

U.S. Pat. No. 3,291,780
U.S. Pat. No. 3,300,459
U.S. Pat. No. 3,598,738
U.S. Pat. No. 4,026,809
U.S. Pat. No. 4,032,700
U.S. Pat. No. 4,156,061
U.S. Pat. No. 3,320,019
U.S. Pat. No. 4,357,250

U.S. Pat. No. 3,598,738, which describes the preparation of ethylene-propylene-1,4-hexadiene terpolymers, is illustrative. This patent also lists numerous references describing the use of various polymerization catalysts.

Another useful polymer is an olefin-conjugated diene copolymer. An example of such a polymer is butyl rubber, an isobutylene-isoprene copolymer.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol. 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts. These polymers may be and frequently are hydrogenated to bring unsaturation to desired levels. As noted, hydrogenation may take place before or after reaction with the carboxylic reactant.

(5) Star Polymer

Star polymers are polymers comprising a nucleus and polymeric arms. Common nuclei include polyalkenyl compounds, usually compounds having at least two non-conjugated alkenyl groups, usually groups attached to electron withdrawing Igroups, e.g., aromatic nuclei. The polymeric arms are often homopolymers and copolymers of dienes, preferably conjugated dienes, vinyl substituted aromatic: compounds such as monoalkenyl arenes, homopolymers of olefins such as butenes., especially isobutene, and mixtures thereof.

Molecular weights (GPC peak) of useful star polymers range from 20,000 to about 4 million. They frequently have $\overline{M}_n$ ranging from about 100,000 to about 2 million.

The polymers thus comprise a poly(polyalkenyl coupling agent) nucleus with polymeric arms extending outward therefrom. The star polymers are usually hydrogenated such that at least 80% of the olefinic carbon-carbon bonds are saturated, more often at least 90% and even more preferably, at least 95% are saturated. As noted herein, the polymers contain olefinic unsaturation; accordingly, they are not exhaustively saturated before reaction with the carboxylic reactant.

The polyvinyl compounds making up the nucleus are illustrated by polyalkenyl arenes, e.g., divinyl benzene and poly vinyl aliphatic compounds.

Dienes making up the polymeric arms are illustrated by butadiene, isoprene and the like. Monoalkenyl compounds include, for example, styrene and alkylated derivatives thereof. In one embodiment, the arms are derived from dienes. In another embodiment, the arms are derived from dienes and vinyl substituted aromatic compounds. In yet another embodiment, the arms comprise polyisobutylene groups. Arms derived from dienes or from dienes and vinyl substituted aromatic compounds are frequently substantially hydrogenated, provided that they are not exhaustively hydrogenated before reaction with the carboxylic reactant.

Star polymers are well known in the art. Such material and methods for preparing same are described in numerous publications and patents, including the following United States patents which are hereby incorporated herein by reference for relevant disclosures contained therein:

U.S. Pat. No. 4,116,917,
U.S. Pat. No. 4,141,847,
U.S. Pat. No. 4,346,193,
U.S. Pat. No. 4,358,565,
and U.S. Pat. No. 4,409,120.

Star polymers are commercially available, for example as Shellvis 200 sold by Shell Chemical Co.

Mixtures of two or more olefinically unsaturated hydrocarbon polymers may be used.

In another embodiment, mixtures of one or more of the olefinically unsaturated hydrocarbon polymers (P) with one or more olefins, other than the olefinically unsaturated hydrocarbon polymers identified as reactant (P) of this invention, may be used. Such a mixture comprises from about 0.1 mole equivalent of carbon to carbon double bonds to about 2 moles of an olefinically unsaturated compound having molecular weight ranging from about 100 to less than 20,000, often up to about 10,000 per mole equivalent of carbon to carbon double bonds in (P) the olefinically unsaturated polymer.

Examples include mixtures of any of the hydrocarbon polymers (P) with lower olefins, such as alpha-olefins containing up to about 100 carbon atom:,, polyolefins, for example polyisobutylene, especially high vinylidene polyisobutylene, having molecular weights ranging from about 500 up to about 5,000, ethylene-propylene-diene compounds such as those identified by the tradename Trilene® and marketed by Uniroyal Chemical Co., and others.

(G) The Carboxylic Reactant

The carboxylic reactant is at least one member selected from the group consisting of compounds of the formula $$R^3C(O)(R^4)_nC(O)OR^5 \quad \text{(IV)}$$

wherein each of $R^3$ and $R^5$ is independently H or a hydrocarbyl group, preferably H or lower alkyl, $R^4$ is a divalent hydrocarbylene group, and n is 0 or 1, and reactive sources thereof. Most preferably $R^3$ is H Reactive sources include compounds of the formula (VI)

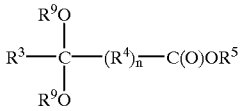

wherein each of $R^3$ and $R^5$ and each $R^9$ is independently H or a hydrocarbyl group, $R^4$ is a divalent hydrocarbylene group, and n is 0 or 1. These include acetals, ketals, hemiacetals and hemiketals of (IV) and esters thereof. Highly preferred are the compounds wherein one of $R^9$ is hydrocarbyl and one is H:

(V)

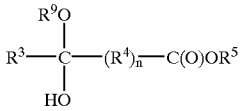

wherein each of $R^3$ and $R^5$ is independently H or a hydrocarbyl group, especially wherein the hydrocarbyl group is lower alkyl. $R^4$ is a divalent hydrocarbylene group, preferably lower alkylene, $R^9$ is hydrocarbyl, preferably lower alkyl, and n is 0 or 1, preferably 0. Especially preferred are the glyoxylate lower alkyl ester, lower alkyl hemiacetals. Cyclic trimers are useful.

Reactant (G) may be a compound of the formula (VII)

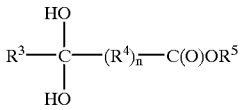

wherein each of $R^3$ and $R^5$ is independently H or alkyl. Such compounds may arise when the carboxylic acid or ester reactant is hydrated.

$R^3$ is usually H or an aliphatic group, that is, alkyl or alkenyl, preferably alkyl, more preferably lower alkyl. Especially preferred is where $R^3$ is H or methyl, most preferably, H.

$R^4$ is a divalent hydrocarbylene group. This group may be aliphatic or aromatic, but is usually aliphatic. Often, $R^4$ is an alkylene group containing from 1 to about 3 carbon atoms. The 'n' is 0 or 1; that is, in one embodiment $R^4$ is present and in another embodiment, $R^4$ is absent. More often, $R^4$ is absent.

When $R^5$ is hydrocarbyl, it is usually an aliphatic group, often a group containing from 1 to about 30 carbon atoms, often from 8 to about 18 carbon atoms. In another embodiment, $R^5$ is lower alkyl, wherein "lower alkyl" is defined hereinabove. Most often, $R^5$ is H or lower alkyl, especially methyl, ethyl, propyl and butyl.

Examples of carboxylic reactants (G) are glyoxylic acid, and other omega-oxoalkanoic acids, glyoxylic acid hydrate, keto alkanoic acids such as pyruvic acid, levulinic acid, ketovaleric acids, ketobutyric acids, esters thereof, preferably the lower alkyl esters, methyl glyoxylate methyl hemiacetal, 4-formylbenzoic acid, 4-formylphenoxyacetic acid, esters thereof, carboxy benzaldehyde, the hemiacetals and hemiketals of keto- or aldehydoalkanoic acids such as glyoxylic acid and keto alkanoic acids such as pyruvic acid, levulinic acid, ketovaleric acids, and ketobutyric acids, and the corresponding acetals and ketals, and numerous others. The skilled worker, having the disclosure before him, will readily recognize the appropriate carboxylic reactant (B) to employ to generate a given intermediate. Preferred carboxylic reactants are those that will lead to preferred products of this invention.

In a preferred embodiment, $R^3$ and one $R^9$ are hydrogen and the other $R^9$ and $R^5$ are methyl. In this preferred embodiment, the reactant is represented by the structure

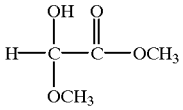

and known as glyoxylic acid methylester methylhemiacetal. It is marketed by DSM Fine Chemicals.

The Catalyst

The first step of the process of this invention is optionally conducted in the presence of an acidic catalyst. Acid catalysts, such as organic sulfonic acids, for example, paratoluene sulfonic acid and methane sulfonic acid, heteropolyacids, the complex acids of heavy metals (e.g., Mo, W, Sn, V, Zr, etc.) with phosphoric acids (e.g., phosphomolybdic acid), and mineral acids, for example, $H_2SO_4$ and phosphoric acid, are useful. Solid acidic catalysts are useful. These include materials such as acidic clays, for example $H_2SO_4$ treated diatomaceous earth supplied under the name Super Filtrol, and polymer-bound acids such as those supplied under the name Amberlyst. Among useful solid catalysts are acidic oxides such as $H_2SO_4$ treated $TiO_2$ and $Al_2O_3$. The amount of catalyst used is generally small, ranging from about 0.01 mole % to about 10 mole %, more often from about 0.1 mole % to about 2 mole %, based on moles of olefinic reactant.

(C) The Heterocycle Precursor

The compositions of this invention may be prepared by reacting the carboxylic group containing intermediate with a heterocycle precursor. These reactions generate the group 'B' in the composition of formula (I). The heterocycle precursor is usually an acyclic reactant that cyclizes with the carboxylic group to form a heterocyclic compound. Materials which are useful as heterocycle precursors are compounds having the general formula $$H\text{—}W\text{-alkylene-}NH_2 \quad \text{(II)}$$

wherein each W is selected from O, S, and $NR^b$, the 'alkylene' group contains from 1 to about 8 carbon atoms, preferably from about 2 to about 4 carbon atoms, and most preferably about 2, which carbon atoms may have one or more substituents selected from the group consisting of hydrocarbyl, hydroxyhydrocarbyl, and aminohydrocarbyl, wherein $R^b$ is H, hydrocarbyl, hydroxyhydrocarbyl, or aminohydrocarbyl, and the general formula

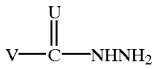

(III)

or salts thereof, wherein V is $H_2N$— or $H_2NNH$—, and U is O, S or NH.

Illustrative of suitable reactants (II) are alkanolamines, mercaptoalkylene amines, and di- and polyamines. Specific examples include ethanolamine, 2-aminopropanol, 2-methyl-2-amino-propanol, tris(hydroxymethyl) aminomethane, 2-mercaptoethylamine, ethylene diamine, 1-amino-2-methylaminoethane, diethylenetriamine, triethylene tetramine, and analogous ethylene polyamines including amine bottoms and condensed amines such as those described hereinbelow, alkoxylated ethylene polyamines such as N-(2-hydroxyethyl)ethylene diamine, and others.

Alkylene polyamines, especially ethylene polyamines, such as some of those mentioned above, are preferred. They are described in detail under the heading "Diamines and Higher Amines" in Kirk Othimer's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products. The mixtures are particularly useful.

Other useful types of polyamine mixtures are those resulting from stripping of the above-described polyamine mixtures removing lower molecular weight polyamines and volatile components to leave as residue what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Texas, designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylenetriamine), 0.72% triethylenetetramine, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

In another embodiment, the polyamines are hydroxy-containing polyamines provided that the polyamine contains at least one condensable —N—H group. Hydroxy-containing polyamine analogs of hydroxy monoamines, particularly alkoxylated alkylenepolyamines can also be used. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups. Such polyamines can be made by reacting the above-described alkylene amines with one or more alkylene oxides. Conditions for carrying out such reactions are known to those skilled in the art.

Another useful polyamine is a condensation product obtained by reaction of at least one hydroxy compound with at least one polyamine reactant containing at least one primary or secondary amino group. These condensation products are characterized as being a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or a hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group.

The hydroxy material (b-i) can be any hydroxy material that will condense with the amine reactants (b-ii). These hydroxy materials can be aliphatic, cycloaliphatic, or aromatic; monools and polyols. Aliphatic compounds are preferred, and polyols are especially preferred. Highly preferred are aminoalcohols, especially those containing more than one hydroxyl group. Typically, the hydroxy-containing material (b-i) contains from 1 to about 10 hydroxy groups.

The hydroxy compounds are preferably polyhydric alcohols and amines, preferably polyhydric amines. Polyhydric amines include any of the above-described monoamines reacted with an alkylene oxide (e.g., ethylene oxide, propylene oxide, butylene oxide, etc.) having two to about 20 carbon atoms, preferably 2 to about 4. Examples of polyhydric arnines include tri-(hydroxypropyl)amine, tris-(hydroxymethyl)amino methane, $^2$-amino-2-methyl-1,3-propanediol, N,N,N',N'-tetrakis(2-hydroxypropyl) ethylenediamine, and N,N,N',N'-tetrakis(2-hydroxyethyl) ethylenediamine.

Among the preferred amines making up b(ii) are the alkylene polyamines, including the polyalkylene polyamines. In another embodiment, the polyamine may be a hydroxyamine provided that the polyamine contains at least one condensable —N—H group. Preferred polyamine reactants include triethylenetetramine (TETA), tetraethylenepentamine (TEPA), pentaethylenehexamine (PEHA), and mixtures of polyamines such as the above-described "amine bottoms".

Preferred combinations of reactants for making the polyamine product include those in which reactant (b-i) is a polyhydric alcohol having three hydroxyl groups or an amino alcohol having two or more hydroxy groups and reactant (b-ii) is an alkylene polyamine having at least two primary nitrogen atoms and wherein the alkylene group contains 2 to about 10 carbon atoms.

The reaction is conducted in the presence of an acid catalyst at an elevated temperature. Catalysts useful for the purpose of this invention include mineral acids (mono, di- and poly basic acids) such as sulfuric acid and phosphoric acid; organophosphorus acids and organo sulfonic acids, alkali and alkaline earth partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; $CaHPO_4$, $CaSO_4$ and $MgHPO_4$; also $Al_2O_3$ and Zeolites. Phosphorus and phosphoric acids and their esters or partial esters are preferred Also useful as catalysts are materials which generate acids when treated in the reaction mixture, e.g., trialkylphosphites. Catalysts are subsequently neutralized with a metal-containing basic material such as alkali metal, especially sodium, hydroxides.

The amine condensates and methods of making the same are described in Steckel (U.S. Pat. No. 5,053,152) which is incorporated by reference for its disclosure to the condensates and methods of making.

Illustrative heterocycle precursors (III) which may react with an acid or acid derivative group to form heterocycles are aminoguanidine and salts thereof, semicarbazide, thiosemicarbazide, carbohydrazide and thiocarbohydrazide, as well as salts thereof such as aminoguanidine bicarbonate. The cyclization reactions which take place are exemplified by those disclosed in *Angewandte Chemie*, International Edition, 2, 459 (1963); *Organic Syntheses*, Coll. Vol. III, 95 (1955); and *Chemical Abstracts,* 57, 804i (1962), which are incorporated by reference for such disclosures.

They may be illustrated as follows:

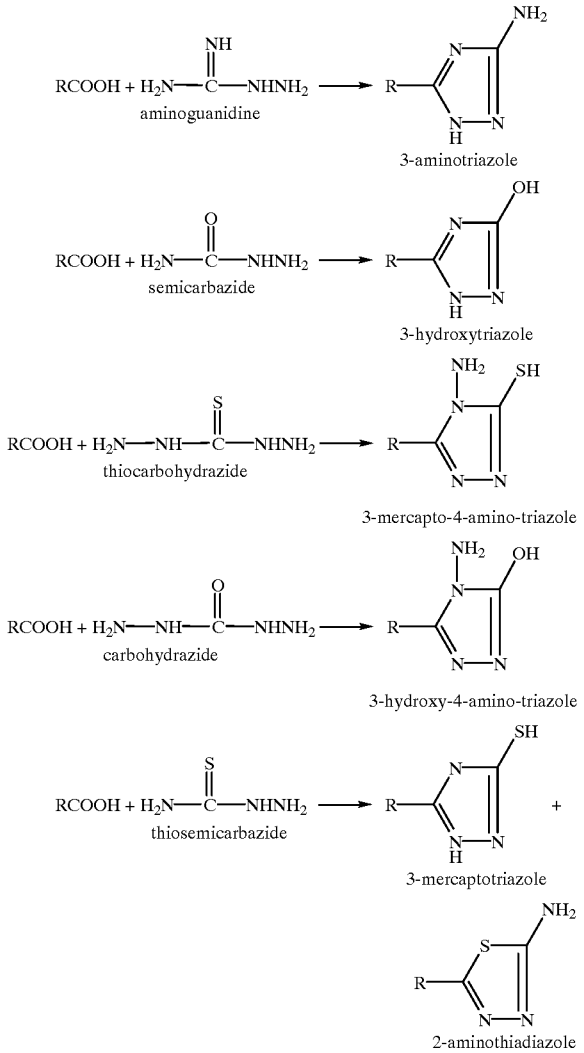

Various other reactions may also form heterocycles. For example, the heterocycle or acyclic heterocycle precursor may react with an acid derivative such as an anhydride or ester. Also, a reaction may take place between an acid or acid derivative group and an active hydrogen-containing atom on the heterocycle formed from the acyclic heterocycle precursor; e.g., the 3-amino or ring NH group of a 3-amino-triazole.

Useful compositions of this invention may be prepared by reacting the carboxylic group containing intermediate with either of H—W-alkylene-$NH_2$ (II) and

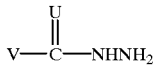

(III)

or salts thereof. Alternatively, the carboxylic group containing intermediate is reacted with both of H—W-alkylene-$NH_2$ (II) and

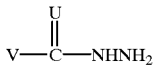

(III), simultaneously or consecutively in any order. When both of (II) and (III) are used., the typical reaction is with from about 20–40 mole % of (II) and from about 60–80 mole % of (III).

In yet another embodiment, the intermediate from the carboxylic acid or functional derivative thereof is reacted with both of at least one heterocycle precursor and at least one additional compound having at least one condensable N—H group, simultaneously or consecutively, in any order.

The at least one additional compound is a reactant that does not form a heterocyclic group B under the conditions described herein.

In one embodiment, the additional compound is the reaction product of a hydrocarbyl substituted acid or anhydride having at least 30 carbon atoms in the hydrocarbyl group and an alkylene polyamine having 2 or 3 carbon atoms in each alkylene group. In another embodiment, the additional compound is a heterocyclic derivative of a fatty acid and an alkylene polyamine containing at least one nitrogen atom in the heterocyclic group.

Primary and secondary monoamines are also useful as additional compounds.

It is possible that the reaction of a carboxylic acid or derivative, such as the intermediate arising from reaction of the polymer (P) and the carboxylic reactant (G), with a heterocycle precursor may, under certain conditions, afford substantial proportions of a non-heterocyclic product. For example, reaction with ethylene diamine or monoethanol amine may generate an amide; with semicarbazide a group of formula

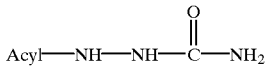

and with thiosemicarbazide,

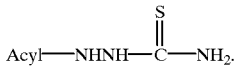

Non-heterocyclic groups of these kinds are included within the definition of the groups 'A' in the composition of Formula (I).

(D) The Hydrocarbyl Substituted Carboxylic Acid or Anhydride.

In still another embodiment, the reaction of the intermediate arising from reaction of (P) and (G) with the heterocycle precursor (C) is conducted, simultaneously or consecutively, with (D), at least one hydrocarbyl substituted. carboxylic acid or anhydride. In this embodiment, typically from about 60% to about 80% of the heterocycle precursor is reacted with a hydrocarbyl substituted carboxylic acid or anhydride before reaction with the intermediate.

Reactant (D), a carboxylic acid or anhydride, may be mono- or polycarboxylic. Suitable carboxylic acids or anhydrides are hydrocarbyl substituted, preferably oil-soluble. These may be aromatic, cycloaliphatic and aliphatic acids. Preferably the hydrocarbyl substituent is aliphatic and contains at least 8 carbon atoms, more preferably at least about 30 carbon atoms. In another embodiment (D) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

Monocarboxylic acids have the formula RCOOH. R is a hydrocarbyl group, preferably an aliphatic group. Preferably, R contains from about 2 to about 500 carbon atoms. In one preferred embodiment, R is an aliphatic group containing from about 8 to about 24 carbon atoms, more often from about 12 to about 18 carbon atoms. Examples of such acids are caprylic, capric, palmitic, stearic, isostearic, oleic, linoleic, and behenic acids.

Another preferred group of monocarboxylic acids is prepared by the reaction of a polyolefin or a halogenated olefin polymer with acrylic acid or methacrylic acid.

Polycarboxylic acids may be illustrated by the general formula $$R—(COOH)_m$$

wherein R is a hydrocarbyl group. R may be aliphatic or aromatic, including alkyl, alkenyl, aralkyl and alkaryl, including mixtures of acids containing aliphatic and aromatic groups. Preferably R is an aliphatic group, and preferably contains from about 5 to about 500 carbon atoms, more preferably from 16 to about 200 carbon atoms, even more preferably from about 30 to about 100 carbon atoms. The subscript 'm' is a number ranging from 2 to about 10, preferably 2 to about 4, more preferably 2 or 3. In an especially preferred embodiment m=2. Mixtures of such acids are also useful.

Patents describing useful aliphatic carboxylic acids or anhydrides and methods for preparing them include, among numerous others, U.S. Pat. No. 3,215,707 (Rense); U.S. Pat. No. 3,219,666 (Norman et al), U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. These patents are hereby incorporated herein by reference for relevant disclosures contained therein.

In another preferred embodiment, the acid or anhydride (D) may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Another group of carboxylic reactants suitable as (D) comprises those obtained by reacting keto- or aldehydocarboxylic acids and functional derivatives thereof with olefinic reactants having molecular weight ranging from about 100 to 20,000, preferably aliphatic mono olefins having from 30 to about 200 carbon atoms. Representative of such materials are products obtained by reacting polyisobutylene ( $\overline{M}_n$~1000) with glyoxylic acid or the methyl ester, methyl hemiacetal thereof. Representative materials are described in European (EP) patent publications 0759443; 0759444; and 0759435.

Further carboxylic reactants suitable as (D) are those obtained by reacting aldehydo- or keto carboxylic acids and functional derivatives thereof with hydrocarbyl substituted, particularly $C_{10-100}$ substituted hydroxy aromatic compounds, preferably phenols. Representative materials are described in U.S. Pat. Nos. 5,281,346; 5,356,546; and 5,336,278.

Other useful acids are hydrocarbyloxypolyoxyalkylenecarboxylic acids. Some examples include: lauryl-O—$(CH_2CH_2O)_{2.5}$—$CH_2CO_2H$; laury-O—$CH_2CH_2O)_{3.3}CH_2CO_2H$; lauryl-O—$(C_3H_6O)_x(CH_2CH_2O)_yCH_2CO_2H$, wherein x=2-3and y=1-2, and 2-octadecanyl-O—$(CH_2CH_2O)_6CH_2CO_2H$. Additionally, polyether alpha, omega-acids, such as 3,6,9-trioxaundecane-1,11-dioic acid and mixed polyether diacids available from Hoechst Chemie can also be incorporated to impart surface activity and polarity, and to affect morphology at low temperatures.

In one embodiment, the hydrocarbyloxypolyoxyalkylenecarboxylic acid is stearyl, preferably isostearyl, pentaethyleneglycolacetic acid. Some of these acids are available commercially from Sandoz Chemical under the tradename Sandopan Acids.

Other acids useful as (D) are aromatic acids such as benzoic, salicylic, hydroxynaphthoic and heterocyclic acids, for example, pyridine dicarboxylic acid and pyrrolidone-5-carboxylic acid.

Polyacids from vegetable- and animal-sourced carboxylic compounds can be used. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid.

Preferred are carboxylic acids, including polyolefin substituted succinic acids, succinic anhydrides, ester acids or lactone acids.

The following examples are intended to illustrate several compositions of this invention as well as means for preparing same. Unless indicated otherwise all parts are parts by weight, temperatures are in degrees Celsius, and pressures in millimeters mercury (mm Hg). Any filtrations are conducted using a diatomaceous earth filter aid. Analytical values are obtained by actual analysis. It is to be understood that these examples are not intended to limit the scope of the invention.

EXAMPLE 1

A reactor is charged with 1500 parts of a solution of 15 parts of an ethylene-propylene-dicyclopentadiene copolymer having about 51 mole % ethylene groups and 2 mole % dicyclopentadiene groups, and having an equivalent weight of about 4,000 per carbon to carbon double bond in 85 parts mineral oil. The materials are heated to 130° C., under $N_2$, whereupon 6 parts methyl glyoxylate, methyl hemiacetal and 1.06 parts methane sulfonic acid are added. The temperature is increased to 145° C. and is maintained for 5 hours. The materials are stripped to 145° C. at 15 mm Hg to yield an intermediate. Another reactor is charged with 250 parts of the residue after stripping and 0.60 parts aminoguanidine bicarbonate (Aldrich), the materials are heated to 165° C., under $N_2$, and are held at temperature for 5 hours. To the product are added 124 parts mineral oil followed by mixing and filtration.

EXAMPLE 2

A reactor is charged with 500 parts of the intermediate described in Example 1, and heated to 1000° C. Then, 0.9 part of aminoguanidine bicarbonate is added, and the mixture is slowly heated to 145° C. with good stirring under a slow stream of $N_2$. A light head of foam forms quickly, then slowly dissipates over 2 hours. The mixture is heated to 160° C. over one hour while removing volatiles, then 30 parts the condensation product of 120 parts of polyisobutene succinic anhydride having an equivalent weight per anhydride of 1200, 100 parts of diluent oil, and 7 parts of polyamine bottoms is added over several minutes. The mixture is stirred at 160° C. under a slow $N_2$ stream for 2 hours, then cooled to yield the product.

EXAMPLE 3

A reactor is charged with 750 parts of the intermediate described in Example 1 and 120 parts of the polyisobutylene succinic anhydride described in Example 2. The mixture is heated with good stirring to 100° C. under a slow $N_2$ stream, and 2 parts of aminoguanidine bicarbonate are added. The stirred mixture is heated to 160° C., and held at that temperature for 2 hour while removing volatiles, then cooled to yield a product.

EXAMPLE 4

A reactor is charged with 500 parts of the intermediate described in Example 1, is heated to 120° C., and 80 parts of a dispersant prepared by condensation of 1300 parts of polyisobutenyl succinic anhydride, having an equivalent weight of 1300 per anhydride, with 200 parts of aminoguanidine bicarbonate and 34 parts of polyamine bottoms are added. The stirred mixture is heated to 160° C., held at that temperature for 2 hour while removing volatiles, then cooled to give a product.

EXAMPLE 5

A reactor is charged with 500 parts of the intermediate described in Example 1, and heated to 100° C. Then 1 part of thiosemicarbazide is added, the mixture is slowly heated to 145° C., held at that temperature for 1 hour, then heated to 160° C. over 1 hour with good stirring under a slow stream of $N_2$. The mixture is held at 160° C. for 2 hours with removal of volatiles then cooled to yield a product.

EXAMPLE 6

A reactor is charged with 500 parts of the intermediate described in Example 1, and heated to 100° C. Then, 0.9 part of aminoguanidine bicarbonate is added, and the mixture is slowly heated to 145° C. with good stirring under a slow stream of $N_2$. A light head of foam forms quickly, then slowly dissipates over 2 hours. The mixture is heated to 160° C. over one hour while removing volatiles, then 0.4 parts of N,N-dimethyl-1,3-propane diamine is added over several minutes. The mixture Lis stirred at 160° C. under a slow $N_2$ stream for 2 hours, then cooled, to yield a product.

EXAMPLE 7

To 500 parts of the product of Example 1 are added 50 parts of the condensation product described in Example 2, and the mixture is blended at 100° C. for one hour, then cooled.

EXAMPLE 8

To 500 parts of the product of Example 5 are added 50 parts of the product made from polyisobutene succinic anhydride, aminoguanidine bicarbonate and polyamines, as described in Example 4. The mixture is blended at 100° C. for one hour, then cooled.

EXAMPLE 9

To a mixture of 3264 parts of polyisobutylene ($M_n$~1000) substituted succinic anhydride, 2420 parts mineral oil and 75 parts water are added, in three portions over 0.5 hours at 80–100° C., 122.1 parts zinc oxide. The materials are reacted for 3 hours at 90–100° C. then the temperature is increased to 150° C. and maintained at this temperature until it is essentially dry. The materials are cooled to 100° C. then there is added, portionwise over 0.5 hours, 245 parts of an ethylene polyamine mixture having an average composition corresponding to tetraethylene pentamine and an average equivalent weight of 40.8. The materials are heated to 150° C. and are maintained at 150° C.–160° C. for 5 hours while $N_2$ blowing to remove water. The materials are filtered. The filtrate contains 1.63% Zn and 0.72% N. A mixture of 112.5 parts of this product, 600 parts of the product of Example 1, and 37.5 parts mineral oil are heated to 100° C. and are mixed for 1 hour then cooled and collected.

Other Additives

The compositions of this invention may contain other components. The use of such additives is optional and the presence thereof in the compositions of this invention will depend on the particular use and level of performance required. Accordingly, these other components may be included or excluded.

The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Ethylene-higher olefin copolymers are especially useful supplemental viscosity improvers. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants are a particularly useful type of additive often included in the lubricating oils described herein. See for example, page 8 of 'Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foarn compositions are described in "Foam Control Agents", by Henry T. Kemer (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Also contemplated are nitrogen and metal such as Zn, Zr, Cu, Ce, Ti, and Cu containing derivatives of a hydrocarbon substituted polycarboxylic acid or functional derivative thereof or a metal containing reactant. Many types of detergents and dispersants are known in the art, and are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529, and in many other U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates,. acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight. In most instances, they each contribute from about 0.1% to about 10% by weight.

Additive Concentrates

The various compositions, including those described as 'other components', described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 50% to about 99%, often to about 95% by weight of the substantially inert, normally liquid organic diluent and about 50% to about 1%, often to about 5% by weight of the compositions of this invention, and may contain, in addition, one or more other additives known in the art or described hereinabove. Concentrations such as 1%, 5%, 15% or 30%, up to about 50%, all by weight, may be employed.

As noted, the compositions of this invention may be used with other materials. In one particular embodiment, a composition comprises the composition of this invention and from about 20% to about 80% by weight of at least one ashless dispersant. In a preferred embodiment, the ashless dispersant is boronated.

In one particular embodiment, this invention relates to an additive concentrate comprising from about 60% to about 88% by weight of a substantially inert organic diluent, from about 6% to about 20% by weight of the product of this invention, and about 6% to about 20% by weight of at least one ashless dispersant such as described hereinabove.

Lubricating Oil Compositions

The lubricating oil compositions of this invention comprise a major amount by weight of an oil of lubricating viscosity and a minor amount by weight of a composition of this invention. By major amount is meant more than 50% by weight, for example 51%, 60%, 90%, 99%, etc. By minor amount is meant less than 50% by weight, for example 1%, 15%, 39%, 49%, etc.

The Oil of Lubricating Viscosity

The lubricating compositions and methods of this invention employ an oil of lubricating viscosity, including natural or synthetic lubricating oils and mixtures thereof. Mixtures of mineral oil and synthetic oils, particularly polyalphaolefin oils, ester and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Hydrotreated naphthenic oils are well known.

Oils of lubricating viscosity derived from coal or shale are also usefill. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing) acids, polymeric tetrahydrofurans, alkylated diphenyloxides and the like.

Many viscosity improvers, and particularly functionalized dispersant viscosity improvers such as acylated polyolefins reacted with amines or alcohols are not readily compatible with certain types of oils of lubricating viscosity, notably polyolefin oils and hydrotreated oils. The dispersant viscosity improvers of this invention display outstanding compatibility with these oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin Ill., U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

The compositions of the present invention are used in lubricating oil compositions in minor amounts, often amounts ranging from about 1% to about 29%, by weight, more often from about 3% to about 10% by weight, even more often from about 5% to about 8% by weight.

A lubricating composition of this invention is illustrated by the following Example. The lubricating composition is prepared by combining the specified ingredients, individually or from concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical. Where oil or other diluent content is given, it is for information purposes only and does not indicate that the amount shown in the table includes oil. Amounts of products of examples of this invention include oil content, if any.

Where percentages of components are on a volume basis, the examples indicate the amounts of diluent (if any) present in the component as percent by weight diluent.

This example is presented for illustrative purposes only, and is not intended to limit the scope of this invention.

Example I

A lubricating oil composition is prepared by blending into a mineral oil basestock (Exxon), 2.3 parts polybutene ($\overline{M}_n \cong 1300$) substituted succinic anhydride-ethylene polyamine reaction product, 0.9 parts Ca overbased (Metal ratio (MR)≅1.1) S-coupled alkyl phenate, 0.25 parts di-(nonyl phenyl)amine, 0.5 parts Ca overbased (MR≅1.2) alkyl benzene sulfonate, 0.4 parts Mg overbased (MR≅14.7) alkyl benzene sulfonate, 0.007 parts of a silicone antifoam agent, 1.1 parts of zinc di-mixed (isopropyl-isooctyl) dithiophosphate, 0.6 parts Ca overbased (MR≅2.3) S-coupled phenate, 1.15 parts of polybutene ($\overline{M}_n \cong 1000$) substituted succinic anhydride-pentaeryduritol/ethylene polyamine reaction product, 0.3 parts of a polymethacrylate pour point depressant, and 8 parts by weight of the product of Example 1.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A process comprising first reacting, optionally in the presence of an acid catalyst, (P) an olefinically unsaturated hydrocarbon polymer having $\overline{M}_n$ ranging from 20,000 to about 500,000 when the polymer is not a star polymer, and up to about GPC peak molecular weight of 4,000,000 when the polymer is a star polymer, with (G) from about 0.1 to about 3 moles per mole-equivalent of (P) of at least one carboxylic reactant selected from the group consisting of compounds of the formula $$R^3C(O)(R^4)_nC(O)OR^5 \quad \text{(IV)}$$

wherein each of $R^3$ and $R^5$ is independently H or a hydrocarbyl group, $R^4$ is a divalent hydrocarbylene group, and n is 0 or 1, and reactive sources thereof to form a carboxylic group containing intermediate, then reacting said intermediate with (C) from about 0.5 to about 1.25 equivalents, per equivalent of carboxylic acid or reactive source thereof, of a heterocycle precursor wherein the reaction with the heterocycle precursor is conducted at a temperature ranging from about 100° C. to about 250° C. for a sufficient time to convert at least about 50% of the carboxylic groups to heterocyclic groups.

2. The process of claim 1 wherein (G) is reacted with a mixture of (P) and olefinically unsaturated compounds having molecular weight ranging from about 100 to less than 20,000.

3. The process of claim 1 wherein (G) is reacted with a mixture comprising from about 0.1 mole equivalent of carbon to carbon double bonds to about 2 moles of an olefinically unsaturated compound having molecular weight ranging from about 100 to less than 20,000 per mole equivalent of carbon to carbon double bonds in (A) the olefinically unsaturated polymer.

4. The process of claim 1 wherein (P) the olefinically unsaturated hydrocarbon polymer is at least one member selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

5. The process of claim 1 wherein the carboxylic reactant (G) is selected from the group of compounds of the formula (VI)

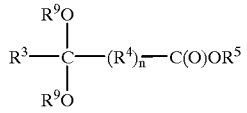

wherein each of $R^3$ and $R^5$ and each $R^9$ is independently H or a hydrocarbyl group, $R^4$ is a divalent hydrocarbylene group, and n is 0 or 1.

6. The process of claim 1 wherein the carboxylic reactant (G) is selected from the group consisting of glyoxylic acid, glyoxylic acid hydrate and compounds of the formula (V)

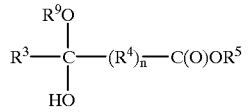

wherein each of $R^3$ and $R^5$ is independently H or alkyl, $R^4$ is lower alkylene, $R^9$ is alkyl and n is 0 or 1.

7. The process of claim 1 wherein the heterocycle precursor (C) is selected from the group consisting of compounds of the formula $$H—W\text{-alkylene-}NH_2 \quad \text{(II)}$$

wherein W is O, S, and $NR^b$, the 'alkylene' group contains from 1 to about 8 carbon atoms, which carbon atoms may have one or more substituents selected from the group consisting of hydrocarbyl, hydroxyhydrocarbyl, and aminohydrocarbyl, and $R^b$ is H, hydrocarbyl, hydroxyhydrocarbyl, or aminohydrocarbyl; and (III)

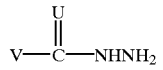

or salts thereof wherein V is $H_2N$— or $H_2NNH$—, and U is O, S or NH.

8. The process of claim 1 wherein the reaction of the intermediate with (C) is conducted, simultaneously or consecutively, with (D), at least one hydrocarbyl substituted carboxylic acid or anyhydride.

9. The process of claim 8 wherein from about 60% to about 80% of the heterocycle precursor is reacted with the hydrocarbyl substituted carboxylic acid or anhydride before reaction with the intermediate.

10. The process of claim 6 wherein (G) the carboxylic acid or reactive source thereof is at least one of glyoxylic acid, the hydrate thereof, or a lower alkyl ester, lower alkyl hemiacetal thereof, and the heterocycle precursor is aminoguanidine bicarbonate.

11. The process of claim 1 conducted in an extruder.

12. A product prepared by the process of claim 1.

13. A product prepared by the process of claim 10.

14. An additive concentrate comprising from about 95% to about 50% by weight of a substantially inert organic diluent and from about 5% to about 50% by weight of the product of claim 12.

15. A lubricating composition comprising a major amount of an oil of lubricating viscosity and a minor amount of-the product of claim 12.

16. A lubricating composition comprising a major amount of an oil of lubricating viscosity and a major amount of the product of claim 13.

* * * * *